US011131135B2

(12) United States Patent
Haubs et al.

(10) Patent No.: US 11,131,135 B2
(45) Date of Patent: Sep. 28, 2021

(54) MOTOR VEHICLE DOOR LOCK

(71) Applicant: Kiekert AG, Heiligenhaus (DE)

(72) Inventors: Rainer Haubs, Voerde (DE); Reinhard Chilla, Velbert (DE); Thomas Welke, Essen (DE)

(73) Assignee: Kiekert AG, Heiligenhaus (DE)

( * ) Notice: Subject to any disclaimer, the term of this patent is extended or adjusted under 35 U.S.C. 154(b) by 621 days.

(21) Appl. No.: 16/069,533

(22) PCT Filed: Dec. 14, 2016

(86) PCT No.: PCT/DE2016/100587

§ 371 (c)(1),
(2) Date: Jul. 12, 2018

(87) PCT Pub. No.: WO2017/121419

PCT Pub. Date: Jul. 20, 2017

(65) Prior Publication Data

US 2019/0024432 A1 Jan. 24, 2019

(30) Foreign Application Priority Data

Jan. 12, 2016 (DE) ..... 10 2016 100 442.1
Feb. 18, 2016 (DE) ..... 10 2016 102 878.9

(51) Int. Cl.
*E05F 15/646* (2015.01)
*E05F 15/643* (2015.01)
(Continued)

(52) U.S. Cl.
CPC ..... *E05F 15/646* (2015.01); *B66D 1/36* (2013.01); *E05F 15/60* (2015.01); *E05F 15/643* (2015.01);
(Continued)

(58) Field of Classification Search
CPC ..... E05F 15/646; E05F 15/655; E05F 15/643
See application file for complete search history.

(56) References Cited

U.S. PATENT DOCUMENTS 4,887,390 A * 12/1989 Boyko ..... B60J 5/06 49/214
5,746,025 A * 5/1998 Shimura ..... B60J 5/06 49/360
(Continued)

FOREIGN PATENT DOCUMENTS

DE 19607527 C2 7/1998
DE 19655332 2/2007
(Continued)

OTHER PUBLICATIONS

International Search Report and Written Opinion for corresponding Patent Application No. PCT/DE2016/100587 dated Mar. 30, 2017.

*Primary Examiner* — Marcus Menezes
(74) *Attorney, Agent, or Firm* — Renner, Otto, Boisselle & Sklar, LLP

(57) ABSTRACT

A vehicle door adjustment unit for a motor vehicle sliding door, having a deflection device for deflecting a rope for automatically opening and/or closing the motor vehicle sliding door. The vehicle door adjustment unit comprises the rope and a first deflection roller and a second deflection roller, in particular having a U-shaped or V-shaped rope receiving profile, wherein a first deflection axis of the first deflection roller and a second deflection axis of the second deflection roller are substantially oriented perpendicular to one another.

17 Claims, 2 Drawing Sheets

(51) Int. Cl.
*E05F 15/655* (2015.01)
*E05F 15/60* (2015.01)
*B66D 1/36* (2006.01)

(52) U.S. Cl.
CPC ..... *E05F 15/655* (2015.01); *E05Y 2201/66* (2013.01); *E05Y 2201/668* (2013.01); *E05Y 2900/531* (2013.01)

(56) References Cited

U.S. PATENT DOCUMENTS 5,794,381 A * 8/1998 Rizkovsky ..... E05F 15/646 49/139
6,134,836 A * 10/2000 Kawanobe ..... E05F 15/646 340/12.22
6,539,670 B2 * 4/2003 Haag ..... E05F 15/646 49/141
6,729,071 B1 * 5/2004 Kawanobe ..... E05F 15/646 49/360
7,243,461 B2 * 7/2007 Rogers, Jr. ..... E05B 85/26 296/155
7,325,361 B2 * 2/2008 Rogers, Jr. ..... E05F 15/643 296/155
10,851,577 B2 * 12/2020 Gokan ..... E05F 15/643
2003/0005640 A1 * 1/2003 Moreau ..... E05F 15/646 49/360
2010/0154313 A1 * 6/2010 Elliott ..... E05D 15/58 49/360
2010/0180508 A1 * 7/2010 Yamaguchi ..... E05F 15/643 49/358
2016/0001641 A1 * 1/2016 Yasunaga ..... E05F 15/657 49/352
2018/0179802 A1 * 6/2018 Haubs ..... B60J 5/06
2018/0347253 A1 * 12/2018 Gokan ..... E05F 15/643

FOREIGN PATENT DOCUMENTS

DE 60315402 5/2008
DE 102006016609 B4 1/2010
EP 2907954 8/2015
WO WO-8101587 A1 * 6/1981 ..... E05D 15/1081

* cited by examiner

MOTOR VEHICLE DOOR LOCK

FIELD OF DISCLOSURE

The invention relates to a motor vehicle door adjustment unit for a motor vehicle sliding door, having a deflection device for deflecting a rope for automatically opening and/or closing the motor vehicle sliding door.

BACKGROUND OF DISCLOSURE

Motor vehicle sliding doors are typically used for delivery vehicles and small vans and more recently increasingly also for passenger cars. All sliding doors have in common that they can be adjusted by a pushing movement into an open position and into a closed position. This pushing movement crucially takes place parallel to the lateral wall of the motor vehicle. The fact that unhindered loading and unloading or boarding and alighting is enabled is especially advantageous.

In particular in passenger cars, sliding doors are increasingly equipped with a motorized adjustment unit for automatically opening and/or closing. An electromotor typically acts as a drive of the adjustment unit and exerts a tensile force on a rope for motorized adjustment of the sliding door which is connected to the sliding door at the other end. The sliding door is pivotably accommodated on the outside of the motor vehicle laterally in a lengthwise direction of the motor vehicle, so that the sliding door can be pushed backwards and forwards in the lengthwise direction. As the drive is generally positioned inside the motor vehicle, in particular statically, the rope runs within the motor vehicle from the drive to an orifice in the motor vehicle chassis from the inside to the outside and is thus conducted through the orifice and deflected by means of a deflection roller that the rope can run on the outside of the motor vehicle in the lengthwise direction into the opposite direction as on the inside in order, for example, to be able to follow a closure movement of the sliding door or to pull open the sliding door automatically, i.e. in a motorized manner.

The deflection roller rotatably attached to a generally vertical rotational axis thus enables the rope to be conducted in a U-shape around a wall-shaped chassis side.

A multitude of components such as loudspeaker boxes, electronic components, etc. are usually accommodated on the inside of the chassis in a confined space. The adjustment drive of the motor vehicle door adjustment unit for the motor vehicle sliding door is therefore regularly arranged, for spatial reasons, not directly behind the deflection roller but at a suitable point on the chassis with sufficiently available installation space. Due to a conducting means, in particular a cover similar to as on a Bowden cable, the rope is therefore conducted from the deflection roller to the adjustment drive.

The conducting route or the cover frequently have a curved course around the intermediate components between the deflection roller and the drive. During the rope movement alternately in opposite directions during opening and closing of the sliding door, rotation of the rope can thus occur around its own axis.

Premature wear to or failure of the connecting points of the rope with the end connections of the rope which couple the rope to the drive or the sliding door can be the consequence. In the case of ropes made of twisted wire bundles or strands, premature wear or failure of the rope itself can also occur.

The aforementioned features known from the state of the art can be combined individually or in any combination with one of the objects according to the invention described hereafter.

SUMMARY OF DISCLOSURE

It is an object of the invention to provide a further developed motor vehicle door adjustment unit for a motor vehicle sliding door.

In order to solve the object, a motor vehicle door adjustment unit acts for a motor vehicle sliding door according to the disclosure. Advantageous embodiments result from the sub disclosure.

The object is solved by a motor vehicle door adjustment unit for a motor vehicle sliding door, having a deflection device for deflecting a rope for automatically opening and/or closing the motor vehicle sliding door, whereby the motor vehicle door adjustment unit comprises the rope and a first deflection roller, fundamentally to deflect the rope, and a second deflection roller, in particular having a U-shaped or V-shaped rope receiving profile, in principle to deflect the same rope, whereby a first deflection axis of the first deflection roller and a second deflection axis of the second deflection roller are oriented perpendicular or substantially perpendicular to one another.

The invention is based on the insight that provision of a perpendicular or a substantially perpendicular second deflection roller arranged behind the first deflection roller acts as a stopper for pivoting of the rope around its own axis and thus by means of the aforementioned characteristics of the invention, rotation around its own axis can be effectively counteracted.

In comparison to other options of a deflection, such as a rod or a simple rounding, deflection rollers require a great deal of installation space proportionately, especially as these are also more technically sophisticated. An expert therefore refrains from using deflection rollers where possible. In the present case, it was ascertained that two deflection rollers arranged according to the disclosure solve the ascertained rotation problem and the advantages thus attained outweigh the disadvantages.

Especially effective counteraction can be enabled in particular with a U-shaped or V-shaped rope receiving profile of the second and/or first deflection roller.

Crucially encompassed perpendicular to one another, in particular an angular range of ±20°, preferably ±15°, ideally ±10°, even more ideally ±5°.

In one embodiment, the first deflection axis and the second deflection axis have a distance to one another which is smaller than the total of a first diameter or radius of the first deflection roller and a second diameter or radius of the second deflection roller.

The distance can therefore be smaller than the diameter of the first and the diameter of the second deflection roller. The distance can also be smaller than the diameter of the first and the radius of the second deflection roller. The distance can also be smaller than the radius of the first and the diameter of the second deflection roller. Finally, the distance can be smaller than the radius of the first and the second deflection roller. Especially effective counteraction of rotation around the rope's own axis can be assisted by such a small distance.

In one embodiment, the first deflection axis and the second deflection axis have the distance stated above orthogonally to the first deflection axis and/or orthogonally to the second deflection axis. The distance must therefore be measured along a straight line orthogonally to the first deflection axis or orthogonally to the second deflection axis. It is also advantageous to measure the distance of a common straight line which is orthogonal on both the first and the second deflection axis. Especially effective counteraction of rotation around the rope's own axis can be assisted by a measured distance oriented in such a way.

In one embodiment, the distance corresponds to at least the first radius of the first deflection roller or the second radius of the second deflection roller. Especially reliable operation and clean conducting of the rope in the deflection rollers can thus be enabled.

In particular, the distance between the intersection points of the deflection rollers can also be measured with the respective deflection axes.

In one embodiment, the rope runs from the first deflection roller directly to the second deflection roller.

Running from the first deflection roller to the second deflection roller means that the rope is deflected by the first deflection roller and the second deflection roller.

Running directly from the first deflection roller to the second deflection roller means that no further deflection roller or any other deflection means is arranged between the first deflection roller and the second deflection roller and acts on the rope.

The rope therefore runs directly from the first deflection roller to the second deflection roller, where "running" means the geometric extension and not a feed movement.

Especially effective counteraction of rotation around the rope's own axis can thus be assisted.

In one embodiment, the rope runs tangentially to the first deflection roller and tangentially to the second deflection roller. If the rope were a line without a diameter, the first and the second deflection rollers would have a common tangential line. The tangent and the rope then lie at points on the first and second deflection rollers displaced in principle by 90° or fundamentally by 90°, or, more precisely, in particular in the trough of a U-shaped rope receiving profile. Especially effective counteraction of rotation around the rope's own axis can thus be assisted.

In one embodiment, the rope is tensioned between the first and the second deflection rollers. Tensioned means crucially running in a straight line. In principle, the course of a tensioned rope in operation deviates by not more than 1 mm, preferably 0.5 mm, from a straight line or sags around this amount. A sufficiently large tensile force and/or small rope length is therefore ensured in principle. In the section of the rope between the first and the second deflection roller, the rope does not enter into contact with any other components. At best, an unscheduled contact with a housing or another safety means surrounding the rope is possible, in particular with sagging of the rope. Due to the tensioned state between the first and the second deflection roller grinding on a different surface and thus wear is prevented.

The greater frictional effects can therefore also contribute to counteracting rotation of the rope around its own axis.

In one embodiment, the deflection device is created such that the rope is deflected by the first deflection roller by at least 90°, preferably 135°, of particular preference exactly or fundamentally by 180°.

Deflecting by an angle means to deflect the angle from a section of the rope running towards the deflection roller to a section of the rope running away from the deflection roller. A deflection angle of 180° therefore means a complete reversal of direction.

Especially effective counteraction of rotation around the rope's own axis can thus be assisted.

In one embodiment, the deflection device is created such that the rope is deflected by the second deflection roller by at least 15°, preferably 30° and/or a maximum of 135°, preferably 90°.

Especially effective counteraction of rotation around the rope's own axis can thus be assisted.

In one embodiment, the first deflection roller and the second deflection roller are surrounded by a common housing.

Installation of the deflection device into an orifice from the outside to the inside of the motor vehicle chassis side can thus simultaneously enable the bonus effect of a sealing and protective effect from external influences. The housing for only the first deflection roller would generally not be large enough to completely cover the orifice.

In one embodiment, the housing of the deflection device is equipped with a first cavity for the first deflection roller and a second cavity for the second deflection roller, whereby the first cavity is connected to the second cavity by means of an orifice opening, the maximum opening width of which is larger than the rope diameter and/or smaller than 1.5 times the thickness of the first deflection roller or the second deflection roller.

Thickness means an extension in the direction of the deflection axis.

An especially great sealing effect can be enabled by means of an orifice opening which is narrow in the aforementioned way.

In one embodiment, a conducting means, in particular a cover, is provided for to conduct and protect the rope in front of or behind the deflection device. Cover means in particular a hose-shaped cover.

In front of or behind the deflection device means that the conducting means are arranged behind the second deflection roller and/or vice versa, viewed from the first deflection roller.

Especially great protection of the rope and a variable course of the route to the connecting point can thus be enabled on the sliding door or the drive.

In one embodiment, the conducting means is firmly connected to a housing of the first deflection roller and/or the second deflection roller. Smooth and low-friction transition between the housing or in particular the second deflection roller to the conducting means, in particular the cover, can thus be enabled.

Furthermore, the provision of a fixed coupling opens up use of the rope and cover as a Bowden cable.

In one embodiment, the conducting means is a Bowden cable-type cover and/or the cover and the rope form a Bowden cable, in principle with a force-fitting and/or positive-locking coupling of the cover to the housing of the deflection device and with the other side on the drive housing. Coupling can occur by lateral shifting with a swallowtail-like connection or a swallowtail connection, for example.

Bowden cable type cover means a hose-shaped sheathing of the rope which can transmit compressive and tensile forces. The provision of a Bowden cable with the cover and the rope enables automatic opening and closing of the motor vehicle sliding door by the drive.

In one embodiment, the first deflection roller and the second deflection roller have equal diameters and/or are of an identical construction.

A motor vehicle door adjustment unit can thus be produced with especially few different components and low cost.

BRIEF DESCRIPTION OF DRAWINGS

Exemplary embodiments of the invention are explained in further detail hereinafter on the basis of figures. Features of the exemplary embodiments can be individually or severally combined with the stressed object.

The following are shown.

DETAILED DESCRIPTION

Figure 1:
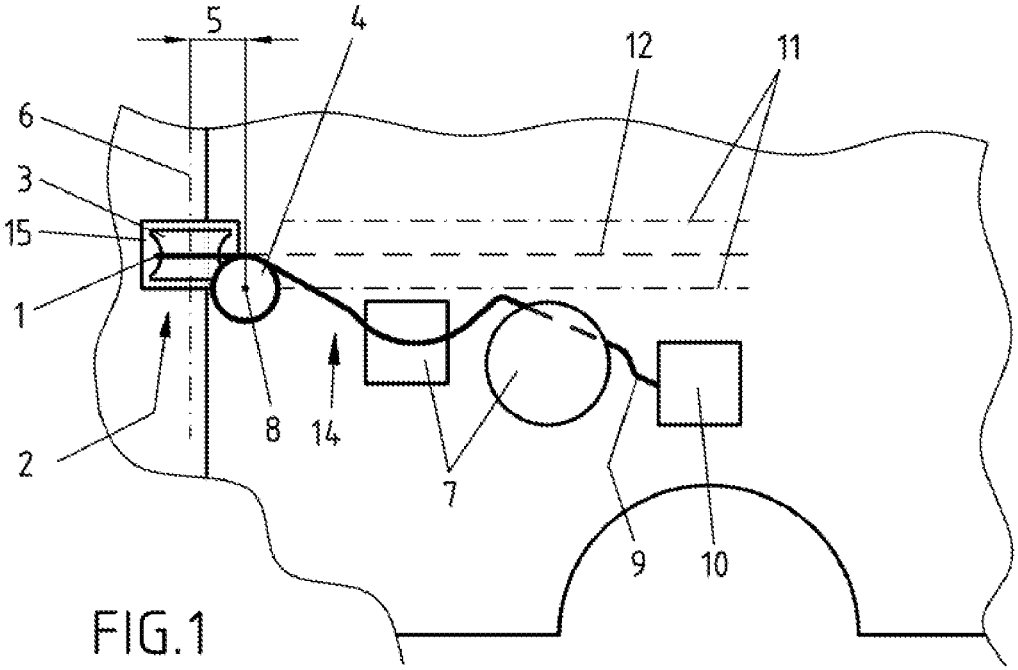
FIG. 1: Diagrammatic illustration of the inside of the motor vehicle chassis with a motor vehicle door adjustment unit for a motor vehicle sliding door

FIG. 1 shows a wall-like motor vehicle chassis side from inside, into which a multitude of components 7, of which FIG. 1 only exemplarily and diagrammatically illustrates two thereof, e.g. loudspeaker or electronic component, are integrated.

A motor vehicle sliding door is attached in a translatorily movable manner laterally on the outside of the wall-like motor vehicle chassis side or the motor vehicle along a guide rail 11 (covered in FIG. 1 and illustrated by a dot-dashed line), so that the sliding door can be pushed backwards and forwards in a lengthwise direction for opening and closing.

A motor vehicle door adjustment unit with a drive 10 is provided for automatic opening preferably also closing of the motor vehicle sliding door. In the present case, the drive 10 is not attached to the sliding door, but firmly attached to a dedicated point on the motor vehicle chassis adjacent to the other components 7.

In an open position of the motor vehicle sliding door, the sliding door is located behind the view in FIG. 1.

A rope 1, which can move the sliding door by means of the drive 10 from the open position to the closed position, i.e. to the left side in the view of FIG. 1, is connected to the drive 10 at one end and to the sliding door at the other end.

From the first end of the rope 1, which is connected or coupled to the sliding door by means of a rope end connection, the rope 1 runs via an external rope route section 12 preferably at the level of the guide rail 11, in particular centrally on the outside of the motor vehicle chassis side to an orifice 15 from the outside to the inside of the motor vehicle chassis side.

In this orifice 15, the first deflection roller 3 is rotatably accommodated on a vertical first deflection axis 6 in order to deflect the rope 1 in a U-shape around the wall-type motor vehicle chassis side.

From the first deflection roller 3 the rope 1 runs directly to a second deflection roller 4 which is rotatably accommodated on a second deflection axis 8 horizontally and orthogonally on the motor vehicle chassis side. A rope route section lying between the first and second deflection roller 3, 4 extends along a common tangential line 13 to the first and second deflection roller 3, 4, such that the rope 1 after detachment from the first deflection roller 3 in a state tensioned in a straight-line parallel to the guide rail 11 and parallel to the motor vehicle chassis side is superimposed on the second deflection roller 4.

After detachment from the second deflection roller 4 an internal rope route section is connected which runs in a curved manner, i.e. in particular partially spiral-shaped or coiled, past the components 7 to the drive 10. The rope 1 on the internal rope route section is partially or completely protected by a cover 9 and is guided past the components 7 in the aforementioned manner.

In order to close the motor vehicle sliding door, the rope 1 is now protracted by means of the drive 10 to the drive 10. The rope 1 therefore moves under tension along a path with the length of the translatory path from the sliding door from the open position into the closed position of the motor vehicle sliding door around the first deflection roller 3 and is deflected by the second deflection roller 4 in its direction by means of the cover 9 in the direction of the drive 10.

The drive 10 advantageously encompasses at least two rollers, whereby on the first roller a first rope 1 is wound during closure and a second rope is unwound by a second roller. The second rope is connected at one end to the sliding door and to the drive 10 at the other end.

If the door is opened, the second rope is guided by means of a second deflection device which is not illustrated. The second rope is protracted by the drive 10 to the drive so that opening of the door is triggered. The second rope is wound accordingly on the second roller within the drive 10 and the first rope 1 is simultaneously unwound on the first roller.

Rotations around the own axis of the rope 1 within the cover 9 on the internal rope route section are effectively prevented by the second deflection roller 4 substantially oriented perpendicular to the first deflection roller 3 on widening of the first deflection roller 3. It is obvious that the same also applies to the second deflection device which is not illustrated.

Advantageously, the deflection device is selected such that it is capable of overcoming a sealing force. It is also conceivable to cause closure of the motor vehicle sliding door to a pre-latching position, so that a non-illustrated closure aid brings the door against the sealing force into the closed position.

Figure 2:
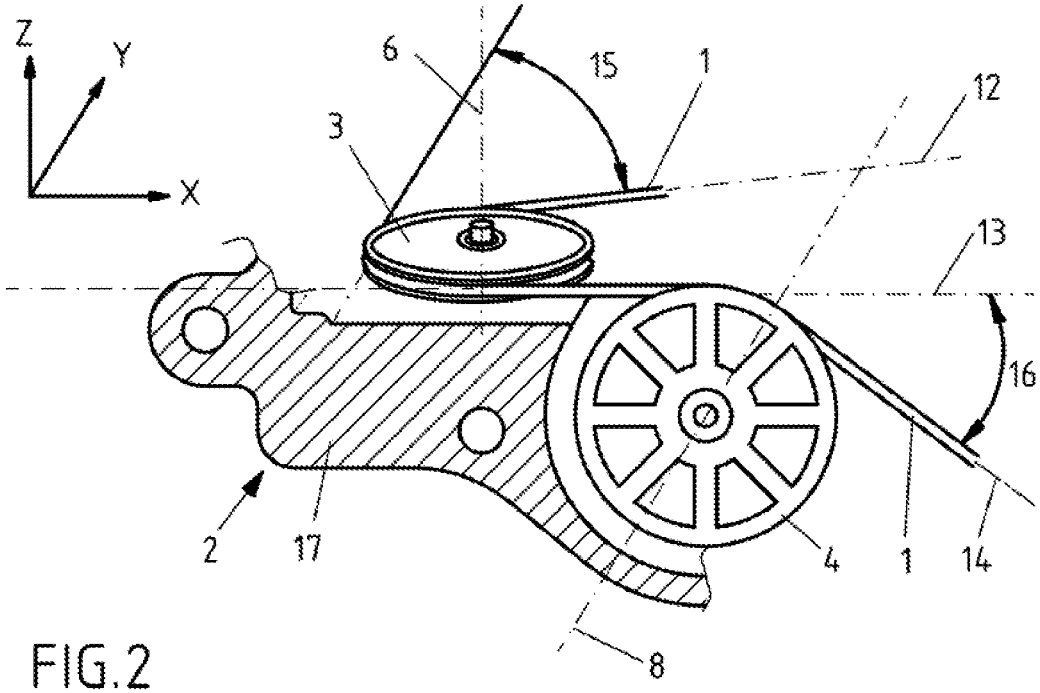
FIG. 2: Partial sectional illustration of the deflection device

FIG. 2 shows the inside of the deflection device 2 with the first deflection roller 3 and the second deflection roller 4 which are of an identical construction in one embodiment.

The first and second deflection rollers 3, 4 are disc-shaped or have a disc-like shape. The deflection rollers 3, 4 have a rope receiving profile on the circumferential surface which is preferably U-shaped or V-shaped. The rope 1 is preferably lies adjacent centrally in the trough of the U-shape or centrally in the V-shape. In particular, the rope receiving profile of the first deflection roller 3 and/or the second deflection roller 4 is in particular adjusted to the rope diameter, that the rope 1 can lie adjacent two-dimensionally on the deflection roller 3, 4. Especially great static friction can thus be attained.

The first deflection roller 3 and the second deflection roller 4 are arranged such that both deflection rollers 3, 4 have a common tangential line 13. This tangential line 13 has the diameter of the rope 1 for the purpose of the present application, so that a rope 1 also running parallel to the guide rail 11 and lying adjacent centrally in the trough of the first and second deflection roller 3, 4 can be described as tangential to the first deflection roller 3 and the second deflection roller 4, although both deflection rollers 3, 4 are oriented perpendicular and shiftably to one another.

Because in reality a first tangential line extends centered in the trough on the lateral receiving profile of the first deflection roller 3 extending along the circumference, precisely parallel at a distance corresponding to the rope diameter to a second tangential line centered in the trough on the rope receiving profile of the second deflection roller 4 extending along the circumference. Thus, the rope 1 can be tensioned parallel to the guide rail 11 between the first and second deflection rollers 3, 4. For a simplified description with only a slight deviation, a common tangential line 13 of the first and second deflection roller 3, 4 was referred to above.

As shown in FIG. 2, the first deflection axis 6 and the second deflection axis 8 have a distance 5 orthogonally to the first deflection axis 6 and orthogonally to the second deflection axis 8 which is larger than the first radius of the first deflection roller 3 and is smaller than the total of the first radius of the first deflection roller 3 and the second radius of the second deflection roller 4. In particular, the distance 5 substantially amounts to the total of the first radius and the half second radius. An especially short distance 5 and thus especially effective stoppage of rotation of the rope 1 around its own axis can thus be enabled.

FIG. 2 shows a coordinate system with the coordinate axes x, y and z, whereby the x-axis runs along the motor vehicle, i.e. along the motor vehicle chassis side and thus also along the guide rail 11. The y-axis extends orthogonally, i.e. parallel to the second deflection axis 8. The z-axis is orthogonal to the x-axis and the y-axis.

The rope 1 is deflected by the first deflection roller 3 by 180° and subsequently by the second deflection roller 4 by 30° (FIG. 2).

In FIG. 2, the rope 1 is accommodated by the external rope route section 12 with a feed angle 15 of 90° to the y-axis from the first deflection roller 3. The discharge angle 16 of the internal rope route section 14 to the x-axis or to the tangential line 13 is 30° in FIG. 2. An especially effective inhibition or prevention of widening of a rotation of the rope 1 around its own axis can thus be attained.

To connect the rope 1 to the sliding door and/or the drive different embodiments are possible of the rope end connections and their connection to the rope 1. In one embodiment, a rope end connection is equipped as a bulb-shaped, spherical or fir-shaped fitting soldered or sealed to the end of the rope. In a further embodiment, the rope end connection has the shape of an eyelet, a hook, a threaded bolt or a knob. In a further embodiment, a rope end connection is provided for with an adjustment means for tensioning of the rope 1. The connection of the rope end connection to the rope 1 can be executed by sealing, soldering or screwing.

In one embodiment, the rope has a rotated wire bundle or rotated strands in order to provide an extremely high tensile strength rope 1 at especially low cost.

In one embodiment, the cover 9 is hose-shaped and/or permits a flexible change in direction during installation. The rope 1 can thus be installed in an especially space-saving manner.

In one embodiment, the rope 1 and the cover 9 form a Bowden cable. Opening and closing of the motor vehicle sliding door by the drive can thus be enabled.

Figure 3:
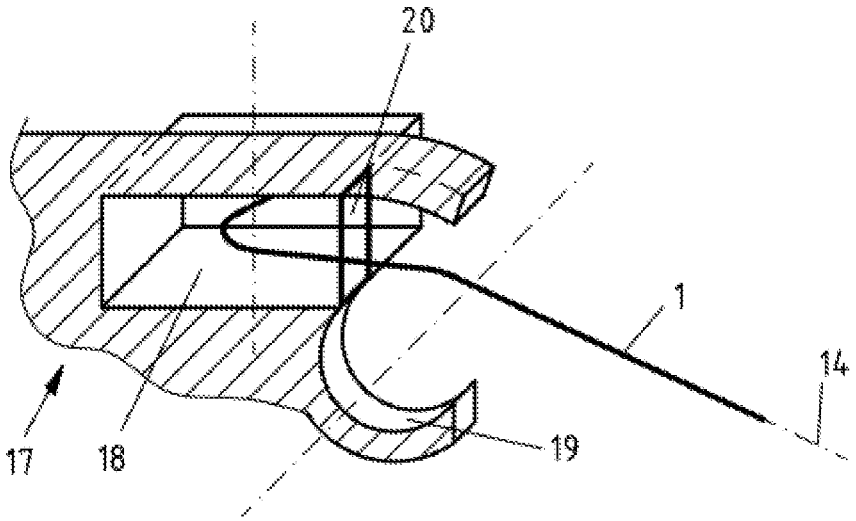
FIG. 3: Diagrammatic illustration of the cavities of the deflection device housing
Figure 4:
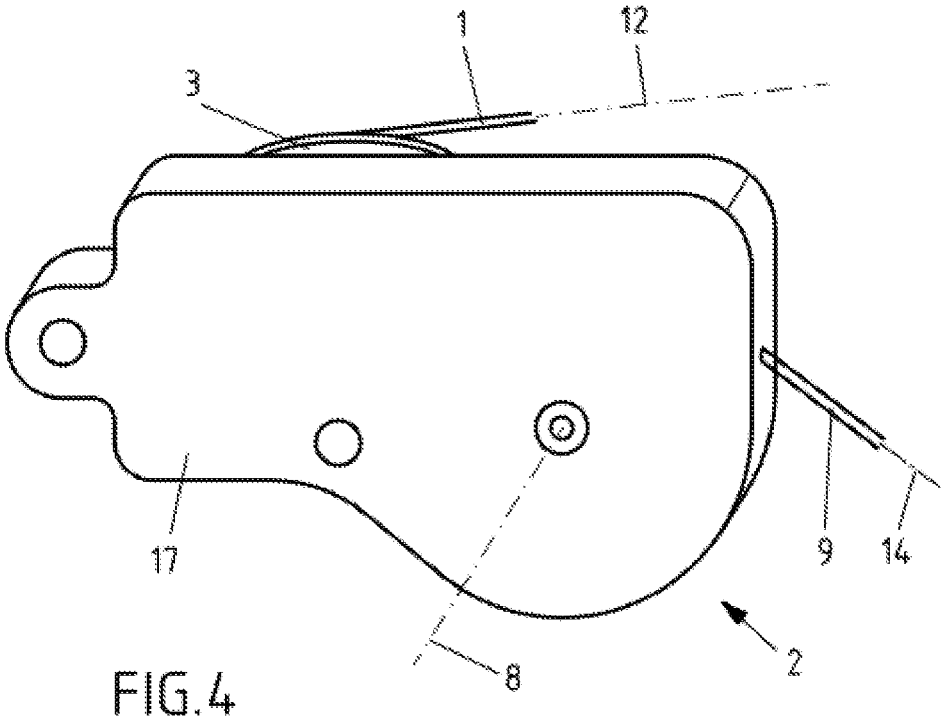
FIG. 4: Illustration of the deflection device

FIGS. 3 and 4 show the structure of the housing 17 (hidden in FIG. 1) of the deflection device 2 with a first cavity 18 for the first deflection roller 3 which is connected by means of an orifice opening 20 with a second cavity 19 for the second deflection roller 4. The cavities 18, 19 are thus adapted to the deflection rollers 3, 4 such that the deflection rollers 3, 4 are predominantly or completely surrounded by the housing 17 and/or only have a narrow gap to an internal surface of the housing 17, i.e. the surfaces of a cavity 18, 19. Thus, not only are the deflection rollers 3, 4 protected from soiling and other influences shortening the lifespan, but the deflection device 2 can simultaneously be used to also protect the inside of the chassis from the external environmental influences and to attain a sealing effect from moisture and similar influences to a certain extent. For this purpose, the deflection device 2 is attached in one embodiment within the orifice 15 or partially or completely covering the orifice 15.

The rope 1 passes an orifice opening 20 with the dimensions in the x-direction and the z-direction of crucially the thickness, i.e. extension in the deflection axis direction, the disk shape of the first deflection roller 3. By means of this comparatively narrow orifice opening 20 and the zig-zag course of the cavity 18, 19 in addition to connection by means of the orifice opening 20 the penetration of external substances inside the chassis can be efficiently counteracted.

The invention claimed is:

1. A motor vehicle door adjustment unit for a motor vehicle sliding door, having a deflection device for deflecting a rope for automatically opening and/or closing the motor vehicle sliding door, the motor vehicle door adjustment unit comprising:

the rope, a first deflection roller, and a second deflection roller having a U-shaped or V-shaped rope receiving profile, wherein a first deflection axis of the first deflection roller and a second deflection axis of the second deflection roller are substantially oriented perpendicular to one another, wherein the first deflection roller and the second deflection roller are surrounded by a common housing, and wherein the common housing has a first cavity for the first deflection roller and a second cavity for the second deflection roller, the first cavity being connected to the second cavity by an orifice opening having a maximum opening width which is larger than a diameter of the rope and smaller than 1.5 times a thickness of the first deflection roller or the second deflection roller, wherein the first deflection axis and the second deflection axis have a distance to one another which is smaller than a total of a first diameter of the first deflection roller and a second diameter of the second deflection roller.

2. The motor vehicle door adjustment unit according to claim 1, wherein a distance between the first deflection axis and the second deflection axis runs orthogonally to the first deflection axis and/or orthogonally to the second deflection axis.

3. The motor vehicle door adjustment unit according to claim 1, wherein a distance between the first deflection axis and the second deflection corresponds to a first radius of the first deflection roller or a second radius of the second deflection roller.

4. The motor vehicle door adjustment unit according to claim 1, wherein the rope runs from the first deflection roller directly to the second deflection roller.

5. The motor vehicle door adjustment unit according to claim 1, wherein the rope runs tangentially to the first deflection roller and tangentially to the second deflection roller.

6. The motor vehicle door adjustment unit according to claim 1, wherein the rope is tensioned between the first deflection roller and the second deflection roller.

7. The motor vehicle door adjustment unit according to claim 1, wherein the rope is configured to be deflected by the first deflection roller by at least 90°.

8. The motor vehicle door adjustment unit according to claim 1, wherein the rope is configured to be deflected by the second deflection roller by at least 15°.

9. The motor vehicle door adjustment unit according to claim 1 further comprising a guide formed as a cover configured to guide and protect the rope in front of and/or behind the deflection device.

10. The motor vehicle door adjustment unit according to claim 9, wherein the guide is firmly connected to the common housing of the first deflection roller and the second deflection roller.

11. The motor vehicle door adjustment unit according to claim 9, wherein the guide forms a Bowden cable cover and/or the cover and the rope form a Bowden cable.

12. The motor vehicle door adjustment unit according to claim 1, wherein the first deflection roller and the second deflection roller have an identical diameter and/or are of an identical construction.

13. The motor vehicle door adjustment unit according to claim 1, wherein the distance is smaller than a total of a first radius of the first deflection roller and a second radius of the second deflection roller.

14. The motor vehicle door adjustment unit according to claim 7, wherein the rope is configured to be deflected by the first deflection roller by at least 135°.

15. The motor vehicle door adjustment unit according to claim 14, wherein the rope is configured to be deflected by the first deflection roller by at least 180°.

16. The motor vehicle door adjustment unit according to claim 8, wherein the rope is configured to be deflected by the second deflection roller by at least 30° and at most 135°.

17. The motor vehicle door adjustment unit according to claim 16, wherein the rope is configured to be deflected by the second deflection roller by at least 90°.

* * * * *